United States Patent [19]

Tanaka et al.

[11] 4,363,083

[45] Dec. 7, 1982

[54] SCREW-BASED INCANDESCENT LAMP TYPE FLUORESCENT LAMP

[75] Inventors: Masashi Tanaka; Nobuhiro Fujii; Yashuharu Takano, all of Yokohama, Japan

[73] Assignee: Toshiba Electric Equipment Corporation, Tokyo, Japan

[21] Appl. No.: 183,282

[22] Filed: Sep. 2, 1980

[30] Foreign Application Priority Data

Sep. 4, 1979 [JP] Japan ..... 54/113320

[51] Int. Cl.[3] ..... F21S 13/00

[52] U.S. Cl. ..... 362/216; 362/294; 362/311; 362/363; 362/373

[58] Field of Search ..... 362/216, 294, 311, 363, 362/373

[56] References Cited

U.S. PATENT DOCUMENTS 3,953,761 4/1976 Lo Giudice ..... 362/216 X 4,208,604 6/1980 Couwenberg ..... 362/216 X

*Primary Examiner*—Stephen J. Lechert, Jr.

*Attorney, Agent, or Firm*—Oblon, Fisher, Spivak, McClelland & Maier

[57] ABSTRACT

A screw-based incandescent lamp type fluorescent lamp comprises a luminous tube bent to define a vacant space therein, a ballast for said luminous tube disposed in said vacant space, a holder having an opening facing said ballast at a given distance therefrom and holding said luminous tube and ballast, a basal body supporting said holder, in which upper ventilation slits are formed, and a light transmitting bottomed envelope attached to said basal body to form an outer tube and having a lower ventilation opening with an opening area smaller than the total area of said upper ventilation holes, whereby air introduced from said lower ventilation opening into said bottomed envelope will flow along the outer peripheral surfaces of said ballast and said luminous tube and be discharged from said upper ventilation slits to the outside via the opening of said holder.

9 Claims, 7 Drawing Figures

SCREW-BASED INCANDESCENT LAMP TYPE FLUORESCENT LAMP

BACKGROUND OF THE INVENTION

This invention relates to a screw-based incandescent lamp type fluorescent lamp with a luminous tube, a ballast and a operating member enclosed in an outer tube.

Fluorescent lamps of this type are used for household illumination and other applications since they can be fitted in lamp sockets for conventional incandescent lamps and have a decided superiority in luminous efficiency over the incandescent lamps.

With one such fluorescent lamp, if a luminous tube and a ballast, having equivalent power consumption of 20 W are incorporated in a bulb or outer tube with a diameter of 120 mm or less, for example, the temperature inside the outer tube will be increased to reduce the total luminous flux of the lamp by approximately 20 to 30% as compared with the brightness obtained with use of a naked luminous tube. Further, the lamp voltage is reduced by approximately 20 to 30%, and the lamp current is increased by approximately 10 to 15%, resulting in the increase of a ballast loss, so that the lamp requires a large-sized ballast and consumption of emitter of a lamp electrode becomes extremely large thereby reducing the lamp life. Accordingly, the lamp requires a large-sized outer tube, a filament of a larger diameter and a great amount of emitter attached to the electrode.

SUMMARY OF THE INVENTION

Accordingly, the object of this invention is to provide a screw-based incandescent lamp type fluorescent lamp capable of fully exhibiting the high-output characteristic of a luminous tube and requiring no increase of ballast, outer tube size and consumption of emitter.

BRIEF DESCRIPTION OF THE DRAWINGS

FIGS. 1 to 4 show a screw-based incandescent lamp type fluorescent lamp according to an embodiment of this invention in which:

FIG. 1 is a general perspective view,

FIGS. 2 and 3 are longitudinal cross-sections as taken along different directions respectively, and FIG. 4 is a disassembled perspective view;

DETAILED DESCRIPTION OF THE PREFERRED EMBODIMENTS

Figure 1:
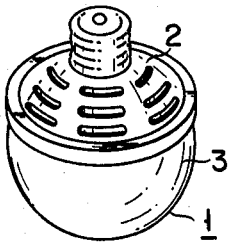
Figure 4:
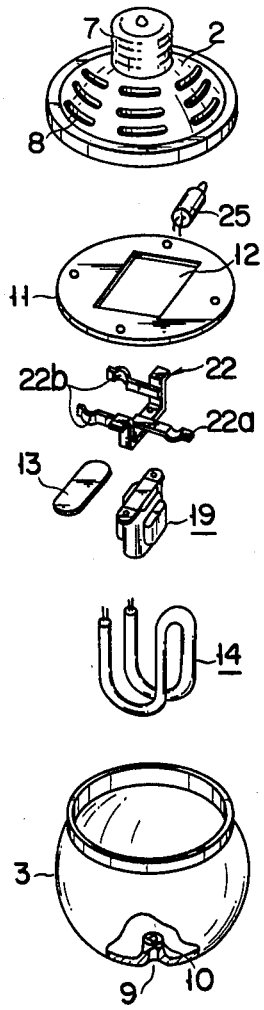
Figure 2:
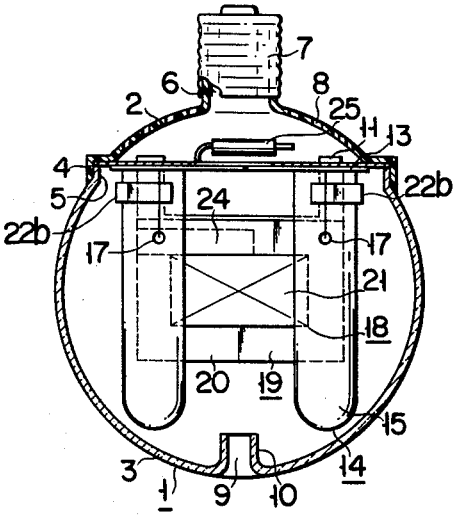
Figure 3:
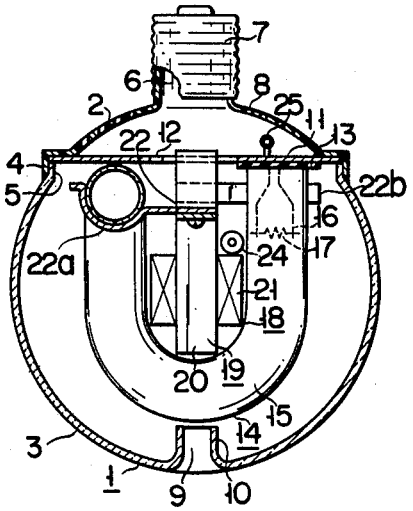

Now there will be described a screw-based incandescent lamp type fluorescent lamp according to an embodiment of this invention with reference to the accompanying drawings.

In FIGS. 1 to 4, numeral 1 designates a substantially spherical outer tube or bulb which is composed of an upper member or base body 2 formed of opaque synthetic resin or glass and a lower member or light transmitting bottom envelope 3 formed of transparent synthetic resin or glass. At the peripheral edge portion of the bottom end opening of the upper member 2, there is formed an annular joint section 4 bent substantially perpendicularly the downward direction. At the peripheral edge portion of the top end opening of the lower member 3, on the other hand, there is formed an annular joint section 5 bent substantially perpendicularly in the upward direction and having a diameter a little smaller than that of the annular joint section 4. After loading with several components as mentioned later, the upper and lower members 2 and 3 are coupled by heat-welding or adhesive-bonding, with the joint section 4 of the former fitted on the joint section 5 of the latter. Alternatively, the two joint sections 4 and 5 may be coupled by combining engaging portions, e.g. engaging projections, formed thereon. In this case, the upper and lower members 2 and 3 can be separated as required after coupling.

A cylindrical mouth section 6 integrally protrudes from the central top portion of the outside of the upper member 2. Around the mouth section 6, there is fitted a base 7 which can be screwed into a lamp socket for incandescent lamps.

A number of slit-like upper ventilation holes 8 are formed substantially all over the surface of the flange section of the upper member 2. These holes 8 are arc shaped, and arranged on a plurality of concentric circles entering around the base 7. A circular lower ventilation hole 9 is bored through the central portion of the bottom of the lower member 3, and an air guide cylinder 10 having substantially the same inside diameter as the ventilation hole 9 integrally protrudes from the inside of the central portion.

Inside the outer tube 1, there is disposed a disc shaped mount 11 in which an air vent section 12 formed of a square opening is defined in the center. The mount 11 is fixed to the upper member 2, having its peripheral edge portion welded or bonded to the annular flat inner surface of the bottom end opening edge of the upper member 2. An insulated circuit board 13 formed of a printed substrate is attached to one side of the under surface of the mount 11.

A luminous tube 14 is disposed in the outer tube 1. The luminous tube 14 is bent in the shape of a U at each end portion, and also bent at the middle portion so that the U-shaped end portions face in parallel with each other to define a vacant space therebetween. A filament coil 17 is mounted on a stem 16 inside each end portion of the tube 14, and lead wires protruding from each end portion are connected to the insulated circuit board 13.

An operating device 18 is disposed inside the outer tube 1. The operating device 18 includes a glow starter 25 and a ballast 19 which, formed of a core 20 and a coil 21 wound round the core 20, is fixed to the mount 11 by means of a mounting frame 22. The mounting frame 22 is composed of a horizontal base portion for mounting the ballast 19, a pair of leg portions each extending upward from both sides of the base portion, and a pair of end portions horizontally extending outward from the respective top ends of the leg portions. The mounting frame 22 may be formed by bending a metal piece or by integrally molding synthetic resin. The ballast 19 is fixed to the under surface of the horizontal base portion of the mounting frame 22 by means of e.g. screws so as to be located in the vacant space inside the luminous tube 14. Moreover, the end portions of the mounting frame 22 are fixed to the top face of the mount 11 on both sides of the air vent section 12 so that the ballast 19 is fixed relatively to the mount 11 under the air vent section 12 at a given distance from the mount 11. A first spring strip **23*a* with one end arcuated protrudes horizontally from the basal portion of the mounting frame 22. Further, a pair of second spring strips 23b each with one end arcuated protrude horizontally in the opposite direction to the first spring strip 23a from their corresponding leg portions of the mounting frame 22. The first spring strip 23a elastically bears the central portion of the luminous tube 14 from below, while the second spring strips 23b laterally support both end portions of the luminous tube 14 with elasticity, respectively. These spring strips 23a and 23b may be formed of the same material with the mounting frame 22. The mount 11 and the mounting frame 22** constitute a holder.

The coil 21 of the ballast 19 is connected with a thermal protector 24, and the glow starter 25 electrically connected with the insulated circuit board 13 is fixed on the top of the mount 11.

The circuit board 13 is electrically connected to the base 7 and contacts by means of lead wires (not shown) to enable electrical operations of the luminous tube 14, ballast 19, thermal protector 24, and glow starter 25.

In use, the screw-based incandescent lamp type fluorescent lamp of the above-mentioned construction is screwed into a lamp socket (not shown) with the base 7 upward, and the luminous tube 14 is caused to glow. When the luminous tube 14 glows, light from the tube 14 is transmitted through the lower member 3 for illumination. When the air temperature inside the outer tube 1 is raised by the heating elements while the luminous tube 14 is glowing, the air is discharged to the outside through the upper ventilation holes 8 in the upper member 2. In response to such exhaust, the outside cold air is introduced into the outer tube 1 through the lower ventilation hole 9 in the lower member 3. The cold air passes around the luminous tube 14 and the ballast 19 inside the lower member 3 while cooling these components, enters into the upper member 2 through the air vent section 12 of the mount 11, and exhausted to the outside through the ventilation holes 8.

Figure 5:
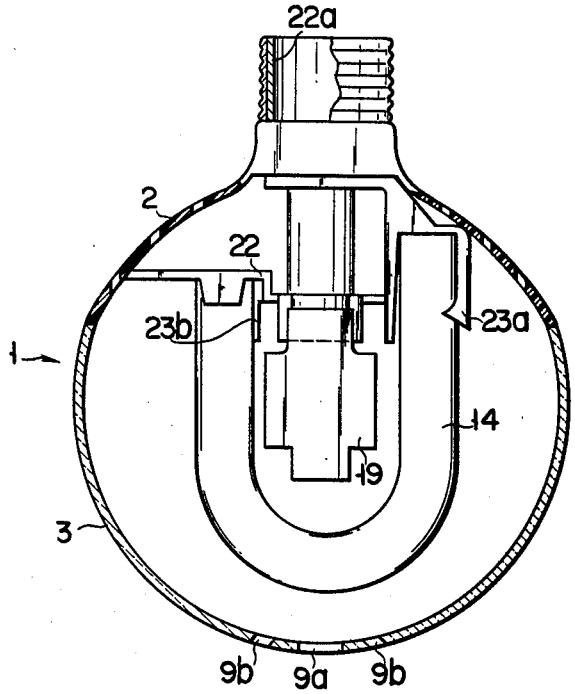
FIGS. 5 and 6 are sectional and plan views of a screw-based incandescent lamp type fluorescent lamp according to another embodiment of the invention, respectively.
Figure 6:
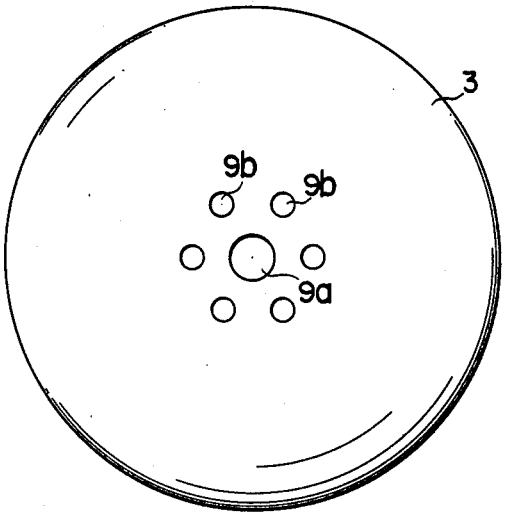

Referring now to FIGS. 5 and 6, there will be described a screw-based incandescent lamp type fluorescent lamp according to another embodiment of this invention. In this embodiment, like reference numerals are used to designate substantially the same portions as those of the foregoing embodiment, and description of such portions is omitted.

In a lower member or bottom envelope 3 of an outer tube 1, there is provided an opening or ventilation means which consists of a ventilation hole 9a formed in the center and six small ventilation holes 9b intensively formed in close vicinity to one another around the hole 9a. These holes 9a and 9b have smaller diameters than that of the ventilation hole 9 of the first embodiment so that their gross opening area may be equivalent to the opening area of the ventilation hole 9. A cylindrical section 22a extending outwardly from the center hole of an upper member or base body 2 protrudes upward from a mounting frame 22 which keeps a luminous tube 14 and a ballast 19 inside an outer tube 1 so that the ballast 19 may be located in a central vacant space inside the luminous tube 14 at a given distance therefrom. A screw base (not shown; same as the base 7 of the foregoing embodiment) is fitted on the screwed outer face of the cylindrical section 22a to fix the mounting frame 22.

Figure 7:
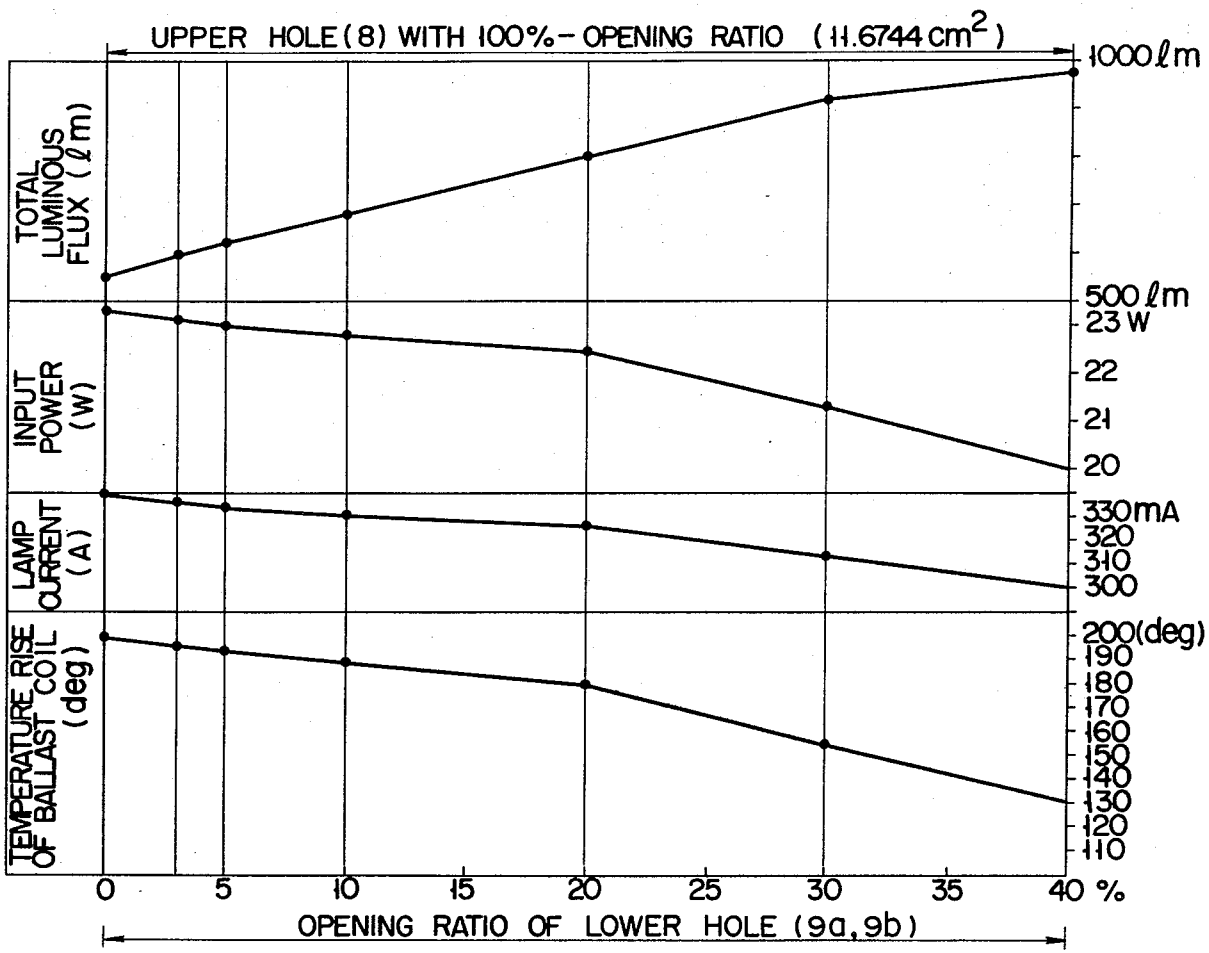
FIG. 7 is a measurement-result diagram for illustrating the characteristics of the lamp of the invention.

FIG. 7 shows measurement results on the total luminous flux of the lamp, input power, lamp current, and the temperature rise of the ballast coil obtained with use of suitably varied dimensions of the lower ventilation holes 9a, 9b and upper ventilation holes 8 in the lamp of the second embodiment.

In the lamp used, the outside diameter of the outer tube is approximately 110 mm, the height including the base is approximately 140 mm, and the luminous tube is a white-light tube rated for 100 V, 20 W. In FIG. 7, the opening ratio is the ratio of the open area of the ventilation holes to the area with which the upper and lower members can have prescribed mechanical strength.

It will be understood from FIG. 7 that the lamp having the upper ventilation holes 8 formed with 100%-opening ratio and the lower ventilation holes 9a, 9b formed with 40%-opening ratio ($10^2 \times 3.14$ mm$^2$) is increased in total luminous flux by approximately 20% and decreased in the temperature rise of the ballast coil by approximately 70%, as compared with a lamp in which the outer tube 1 is provided with none of the upper and lower ventilation holes 8 and 9a, 9b.

The effect of the aforementioned cooling operation increases as the total area of the upper ventilation holes and the total area of the lower opening (lower holes) increases. However, the ventilation holes and opening should preferably be minimized in size in view of the maintenance of the mechanical strength of the outer tube, as well as prevention of undesired invasion of insects or users' fingers and protection of the appearance of the lamp. Thereupon, in order to obtain the cooling effect efficiently with minimized air hole area, it is effective to make the total area of the upper ventilation holes 8 greater than the total area of the lower ventilation holes 9. Also in this case, the lower opening 9 preferably has an area of $3^2 \times 3.14$ mm$^2$ or more.

Although the outer tube is substantially spherical in the above-mentioned embodiments, it may be cylindrical or of any other shape. The spherical outer tube, if used, should preferably have a diameter of 120 mm or less. The luminous tube is not limited to one in number, and may be a combination of two tube units. In this case, the ballast need be located in the middle of such combination, that is, between the two luminous tube units. Moreover, the coil of the ballast may be provided with a coil protection cover, and, alternatively, the ballast may be replaced with an electronic operating device formed of a semiconductor element capable of limiting current.

If the ballast is disposed in the vacant space of the luminous tube, it is not always necessary to arrange the other member or members constituting an operating device in said vacant space.

In the screw-based incandescent lamp type fluorescent lamp according to this invention, as described above, the outside cold air is introduced into the envelope through the bottom ventilation opening, and is passed along the outer peripheral side of the ballast and luminous tube disposed in the envelope to cool these components. Thereafter, the air heated by the ballast and luminous tube is introduced into the base body through the opening of the holder, and discharged therefrom to the outside through a plurality of ventilation holes formed in the base body. Thus, there may be prevented the reduction of lamp light output, drop of lamp voltage, and increase of lamp current that are attributable to a rise in temperature of the ballast and luminous tube. Since the opening or holes are formed intensively at the bottom portion of the envelope, they spoil the beauty of the lamp less than ones formed in the peripheral side portion do. Furthermore, the open area of the lower opening, which is more conspicuous, is narrower than the total area of the upper holes, so that the appearance of the lamp, as well as the cooling effect, will be improved.

What is claimed as new and desired to be secured by Letters Patent of the United States is:

1. A screw-based incandescent lamp type fluorescent lamp comprising:

a luminous tube bent to define a vacant space therein;

an operating member including a ballast for said tube, the ballast disposed in said vacant space;

a holder having an opening facing said ballast at a given distance therefrom and holding said tube and ballast;

a base body supporting said holder and having a flange section in which a plurality of upper ventilation holes are formed;

a light transmitting bottom envelope having an end edge attached to the peripheral edge of the flange section of said base body and surrounding said tube, at least one lower ventilation opening with an opening area larger than 0.2826 $cm^2$ and smaller than the total area of said upper ventilation holes being formed in the bottom of said envelope; and a screw base disposed on the top portion of said base body and electrically connected with said tube and said operating member, whereby air introduced from said lower ventilation opening into said light transmitting bottom envelope will flow along the outer peripheral surfaces of said ballast and said tube and be discharged from said upper ventilation holes to the outside via the opening of said holder.

2. The fluorescent lamp of claim 1 wherein said total area of said upper ventilation holes is 11.6744 $cm^2$.

3. The fluorescent lamp of claim 2 wherein the diameter of said bottom envelope is less than 12 cm.

4. The fluorescent lamp of claims 1 or 2 or 3 wherein said opening area of said at least one lower ventilation opening is less than 40% of said total area of said upper ventilation holes.

5. A fluorescent lamp according to claim 1 or 2 or 3 wherein said lower ventilation opening is a plurality of through holes intensively formed in close vicinity to one another in the bottom of said envelope.

6. A fluorescent lamp according to claim 5, wherein said plurality of through holes include a first through hole formed in the center of the bottom and second through holes smaller than said first through hole in diameter and surrounding said first through hole.

7. A fluorescent lamp according to claim 1 or 2 or 3 wherein said lower ventilation opening is a single through hole formed near the center of the bottom of said envelope.

8. A fluorescent lamp according to claims 1 or 2 or 3, wherein said holder separates the interior of said flange section and the interior of said envelope, said interiors communicating by said opening formed in said holder so that the air introduced from said lower ventilation opening into said envelope may intensively pass through said opening formed in said holder.

9. A fluorescent lamp according to claim 8, wherein said base body and said envelope form a substantially spherical shape.

* * * * *